United States Patent [19]

Weidt

[11] 4,291,804

[45] Sep. 29, 1981

[54] STACKABLE TRANSPORT AND/OR STORAGE CONTAINER WITH ACCESS OPENING

[75] Inventor: Karl A. Weidt, Siegen, Fed. Rep. of Germany

[73] Assignees: Fritz Schafer Gesellschaft Mit Beschrankter Haftung, Salchendorf bei Neunkirchen, Fed. Rep. of Germany; Fabriken fur Lager- und Betriebseinrichtungen, Neunkirchen, both of Fed. Rep. of Germany

[21] Appl. No.: 141,485

[22] Filed: Apr. 18, 1980

[30] Foreign Application Priority Data

Apr. 19, 1979 [DE] Fed. Rep. of Germany ..... 2915812

[51] Int. Cl.[3] ..... B65D 21/02; B65D 25/04

[52] U.S. Cl. ..... 206/509; 220/22

[58] Field of Search ..... 206/509, 510, 511, 512; 220/22, 22.1, 22.2, 22.3, 23.6

[56] References Cited

U.S. PATENT DOCUMENTS 4,015,714 4/1977 Silver ..... 206/511

FOREIGN PATENT DOCUMENTS 2518396 12/1975 Fed. Rep. of Germany ..... 220/23.6

*Primary Examiner*—George E. Lowrance
*Attorney, Agent, or Firm*—Karl F. Ross

[57] ABSTRACT

An open-topped box of rectangular horizontal outline, with vertical side and rear walls, has a forwardly slanting front wall terminating at about half the height of the box in a forwardly and downwardly bent handgrip. The handgrip merges at its ends into inner boundaries of two hollow upstanding corner profiles which flank the access opening left above the front wall and have shoulders rising from the bottom to the top of that opening, the lower portions of these shoulders being aligned with two more forwardly positioned ribs of the corner profiles defining with those lower portions a pair of vertical guide grooves for a closure plate insertable from above even when the box is overlain by a similar box to form a stack. The closure plate may be a hinged dust cover of L-profile whose short horizontal leg, resting on the handgrip, projects forward and ends in a pair of gudgeons abutting two webs of lesser height than the ribs also projecting from the corner profiles, the dust cover being provided near its upper edge with lateral wings which are the only parts received in the guide grooves and which can be lifted out of these grooves to let the dust cover pivot forward about its gudgeons into a depending position unblocking the access opening.

10 Claims, 8 Drawing Figures

STACKABLE TRANSPORT AND/OR STORAGE CONTAINER WITH ACCESS OPENING

FIELD OF THE INVENTION

My present invention relates to a stackable container for the storage and/or transportation of documents and other articles, the container comprising a preferably open-topped box with an access opening in front and with a closure plate removably obstructing that access opening.

BACKGROUND OF THE INVENTION

A box of this general type, made of synthetic sheet material, has been described for example in U.S. Pat. No. 3,163,319. The side and rear walls of the prismatic box, which has a rectangular horizontal outline, have a U-shaped top ledge provided with an upstanding marginal ridge which is outwardly offset from the side and rear edges of the bottom wall to embrace the lower part of an identical second box stacked thereon. The box also has a front wall which rises with a forward slope from the bottom wall and forms at an upper edge thereof a forwardly bent handgrip which is also the lower boundary of the aforementioned access opening.

In order to stiffen such a box against lateral spreading of its sidewalls under the weight of overlying boxes of a stack, it is customary—as also shown in the above-identified U.S. patent—to provide these sidewalls in the region of the front wall with hollow upright corner profiles defining the lateral boundaries of the access opening. In order to be able to retain a closure plate in that opening, these corner profiles must have suitable formations enabling the insertion and withdrawal of such a plate.

When an individual container of this description is placed on a shelf, there is usually enough room between its top ledge and the next-higher shelf to enable the insertion and removal of a cover plate receivable in a pair of vertical guide grooves on opposite sides of the access opening. In the case of stacked containers, however, there is not enough clearance with conventional constructions to allow for the necessary vertical sliding motion. In such instances the closure plate may be designed as a hinged flap swingable about a horizontal pivotal axis to serve as a dust cover. Difficulties are, however, encountered in securing such a flap in its closed position, especially when the container must take a bumpy ride on a roller conveyor or is otherwise subjected to rough handling during transportation. An untimely release of the dust cover may then lead to spillage of the contents if the box is filled above the level of the handgrip.

OBJECT OF THE INVENTION

Thus, the object of my present invention is to provide an improved container of the aforedescribed type facilitating the insertion and removal of a closure plate even in a stack while insuring the safe retention of that plate in its blocking position during transportation and handling.

SUMMARY OF THE INVENTION

This object is realized, in accordance with the present invention, by providing the corner profiles of the box with vertical formations defining a pair of guide grooves which rise substantially from the level of the upper edge of the front plate are over part of the height of the access opening, these guide grooves lying in a vertical plane located far enough forwardly of the foot of the sloping front wall to facilitate the insertion of the closure plate even in the presence of an overlying second box of identical configuration.

The closure plate here considered, which is preferably transparent to enable a viewing of the contents of the box, may be flat and rectangular so as to be insertable and withdrawable only by a vertical sliding motion. With the guide grooves bounded by the coplanar shoulders of the corner profiles and by two ribs in front of these shoulders, the plate may also be designed as a hinged flap or dust cover in which case a major portion thereof has a width less than the spacing of the ribs and is provided at its top with a pair of lateral wings received in these grooves while having a pair of lateral projections at its bottom which abut respective webs rising in front of the ribs to a height substantially less than that of the latter. Upon extraction of the wings from the grooves, the plate can then pivot about the axis of these projections which are advantageously designed as cylindrical grooves.

The handgrip formed by the sloping front wall may have a vertical cross-section substantially of inverted-J shape, as known per se from the prior U.S. patent referred to above, so as to end in a depending front skirt. A particularly cohesive container structure is obtained if, pursuant to a further feature of my invention, the sidewalls of the box have laterally projecting bottom flanges with curved front ends which merge into forwardly and upwardly sloping bottom edges of the corner profiles rising to the lower edge of that front skirt to form therewith a continuous boundary line. Advantageously, the vertical plane defined by the shoulders of the corner profiles at the rear edges of the guide grooves intersects the sloping front wall substantially at the level of the lower front-skirt edge to provide a maximum vertical clearance for the insertion and extraction of the cover plate.

BRIEF DESCRIPTION OF THE DRAWING

The above and other features of my invention will now be described in detail with reference to the accompanying drawing in which.

SPECIFIC DESCRIPTION

Figure 1:
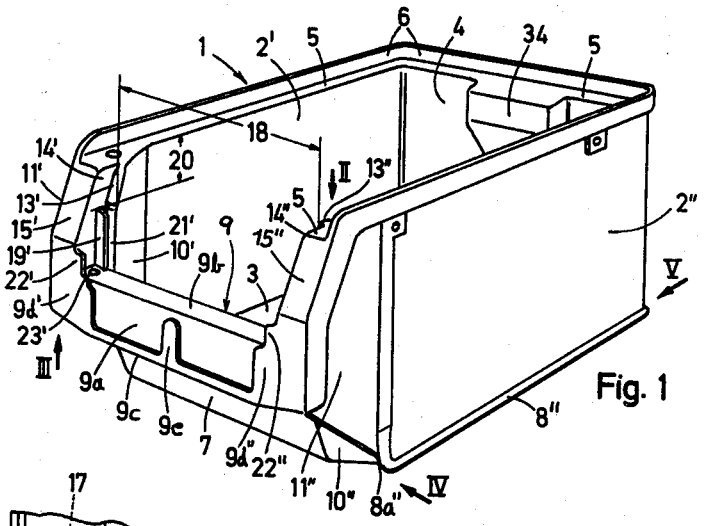
FIG. 1 is a perspective view of a container embodying the invention, with its closure plate omitted.
Figure 2:
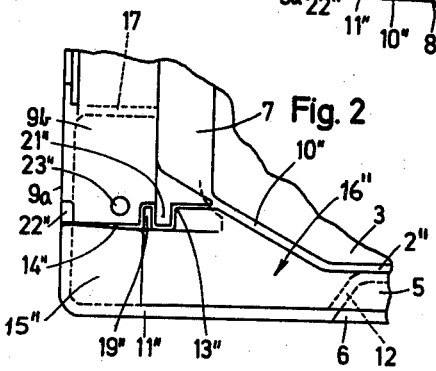
FIGS. 2, 3, 4 and 5 are fragmentary views, drawn to a larger scale, as seen in the direction of respective arrows II, III, IV, V in FIG. 1.
Figure 4:
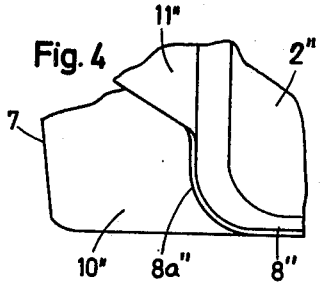
Figure 3:
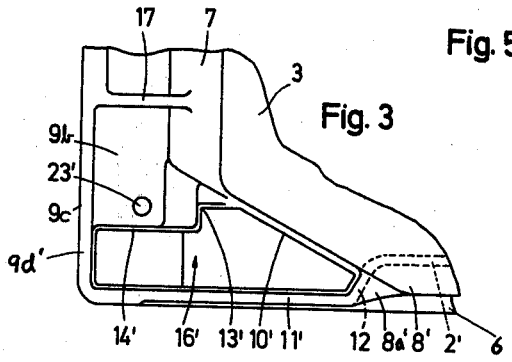

In FIGS. 1–5 I have shown a stackable transport and/or storage container comprising an open-topped box 1 with two sidewalls 2' and 2'', a bottom wall 3 and a rear wall 4 defining a prism of substantial rectangular horizontal outline. Walls 2', 2'' and 4 form a U-shaped top ledge 5 bounded by an upstanding marginal ridge 6 which is designed to embrace a similar box seated on the ledge 5 to form a stack as illustrated at 1A, 1B in FIGS. 5, 6 and 7.

The front of the box is partly closed by a wall 7 sloping forward and upward from bottom wall 3 to about half the height of the side and rear walls. Front wall 7 terminates in a horizontal handgrip 9, with a vertical cross-section substantially of inverted-J shape (see particularly FIGS. 6 and 7), which is folded forward, down and up again so as to form a depending skirt 9*a*, a horizontal land 9*b* and a bight 9*c* flankd by cheeks 9*d*′ and 9*d*″. Bight 9*c* forms a pocket which can be used for the insertion of a label held in position by an upstanding central lug 9*e*.

Figure 5:
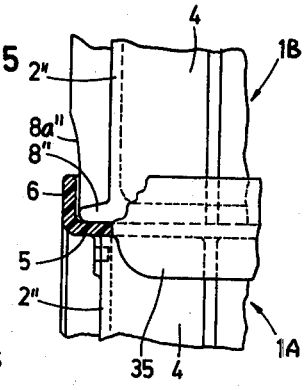

Sidewalls 2′ and 2″, which like rear wall 4 are set back from the overhanging ridge 6, are broadened at the bottom to form a pair of horizontal flanges 8′, 8″ just fitting inside the ridge 6 of an underlying box as best seen in FIG. 5. The two lateral bottom flanges 8′ and 8″ have curved front ends 8*a*′ and 8*a*″ which merge into forwardly and upwardly sloping lower edges of forward extensions 11′, 11″ of sidewalls 2′, 2″, these lower edges rising substantially to the level of bight 9*c* where they join the cheeks 9*d*′ and 9*d*″ of handgrip 9. Two hollow corner profiles 16′, 16″ have outer walls formed by extensions 11′, 11″, front walls formed in part by cheeks 9*d*′, 9*d*″, and inner walls 10′, 14′ and 10″ 14″ separated by transverse shoulders 13′ and 13″ whose lower portions lie in a vertical plane 24 (see FIG. 6) perpendicular to sidewalls 2′ and 2″. Ledge 5 extends across the tops of profiles 16′, 16″ and terminates at two wall portions 15′, 15″ sloping down to cheeks 9*d*′ and 9*d*″. These profiles, accordingly, form integral links between handgrip 9 and sidewalls 2′, 2″ which, for the most part, are recessed from the planes of profile walls 11′ and 11″ as indicated at 12 in FIG. 2 for the right-hand sidewall 2″. In order to facilitate the molding of the box as a unitary body, some of its essentially vertical wall surfaces may be given a slight draft as particularly indicated for walls 2″, 10″, 13″ and 14″ in FIG. 2. The box is further provided with reinforcing ribs 17 inside handgrip 9.

The inner profile walls 10′ and 10″ converge forwardly up to their junctions with shoulders 13′ and 13″, which form the lateral boundaries of a rectangular access opening 18 whose lower boundery is the land 9*b* and whose upper boundary is the bottom of an overlying box. Two vertical ribs 19′ and 19″ rise from land 9*b* adjacent profile walls 14′, 14″ in front of shoulders 13′, 13″ to a height which is somewhat less than the distance between that shelf and the top ledge 5. The vertical lower portions of shoulders 13′ and 13″ are coextensive in width and in height with the ribs 19′, 19″ with which they define two vertical guide grooves 21′ and 21″. Above these grooves the two shoulders slope rearwardly over a vertical distance 20, which is somewhat less than the height of the ribs, until they reach the ledge 5. The plane 24 defining the rear boundaries of grooves 21′ and 21″ lies forwardly of the lower edge of the sloping front wall 7 as best seen in FIG. 6.

Figure 6:
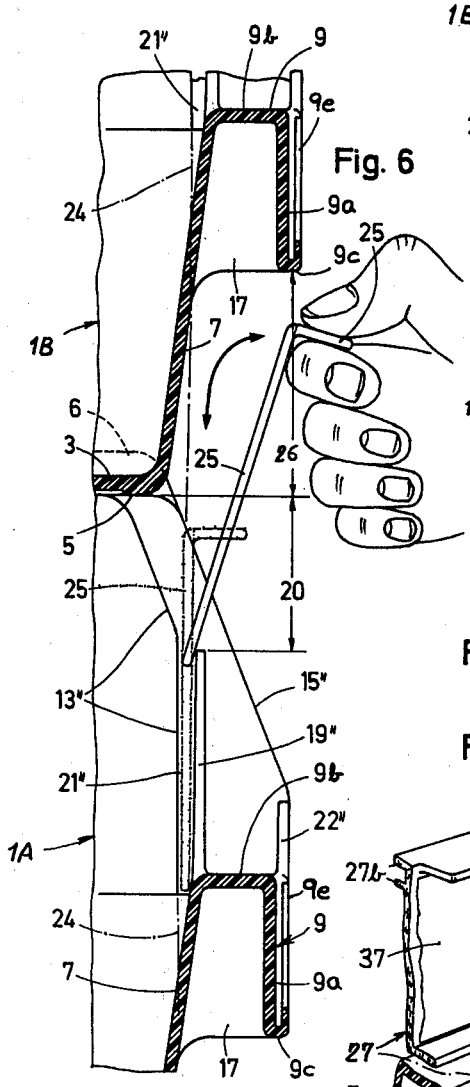
FIG. 6 is a fragmentary view, in sectional elevation, of a stack of two containers according to FIGS. 1–5, showing the insertion or removal of one type of closure plate.

With this arrangement a preferably transparent closure plate 25, shown in FIG. 6, can be readily inserted from above into guide grooves 21′ and 21″. Such a plate can be inserted into and withdrawn from a box 1A even if the same is overlain by another box 1B. In its inserted position, indicated in phantom lines, plate 25 forms a lid across access opening 18 (FIG. 1) and is secured against accidental detachment since the ribs 19′ and 19″ extend over more than half its height. With plane 24 intersecting the front wall 7 of box 1B approximately at the level of its bight 9*c*, whose distance from the bottom of box 1B has been designated 26, the height of the closure plate only needs to be slightly less than the combined distance 20+26 between the top of the ribs on box 1A and the lower edge of handgrip 9 of box 1B. Plate 25 is shown provided at its top with a forwardly projecting tab 25*a* which can easily be gripped by the fingers of a user.

Figure 7:
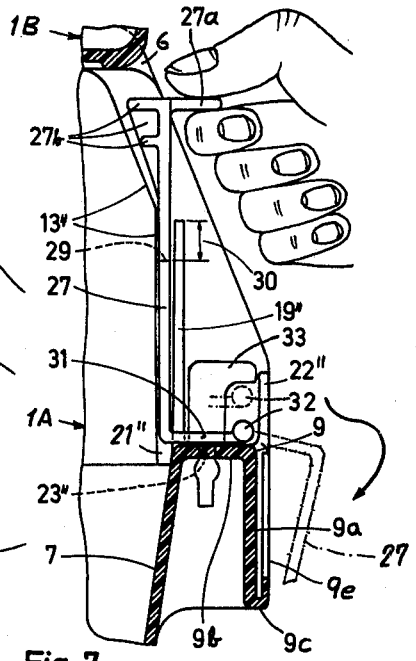
FIG. 7 is a view similar to FIG. 6 illustrating another type of closure plate.
Figure 8:
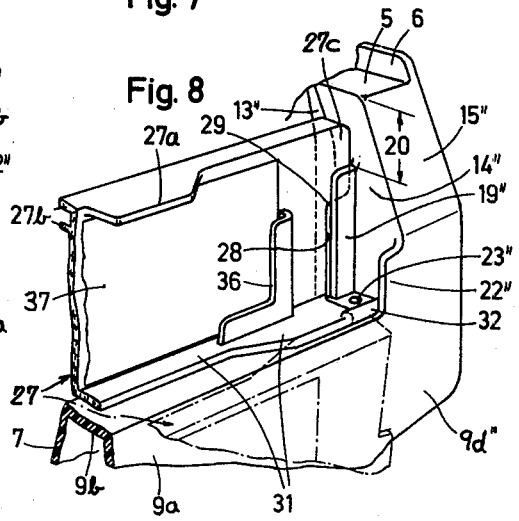
FIG. 8 is a fragmentary perspective view of a container with the closure plate of FIG. 7.

A somewhat different closure plate 27 shown in FIGS. 7 and 8 has a similar tab 27*a* and reinforcing ribs 27*b* at the top of a longer vertical leg of a substantially L-shaped profile whose shorter leg 31 terminates at its front edge in a pair of lateral projections 32 having the shape of cylindrical gudgeons. The sides 28 (FIG. 8) of plate 27 are cut back below a line 29 so that the width of this plate, in contrast to that of the plate 25 as shown in FIG. 6, is less than the spacing of ribs 19′ and 19″ from each other over a major portion of its height. Above line 29, which in the insertion position (full lines in FIGS. 7 and 8) lies at a small distance 30 below the top of the ribs, plate 27 forms a pair of lateral wings 27*c* of which only one is shown in FIG. 8. The gudgeons 32 come to lie behind a pair of webs 22′, 22″ (see also FIG. 1) which extend upward from the cheeks 9*d*′, 9*d*″ of handgrip 9 to a height substantially less than that of ribs 19′, 19″ but somewhat greater than distance 30. When the closure plate 27 is raised by that distance 30, its wings 27*c* clear the guide ribs 19′ and 19″ while gudgeons 32 are still restrained by the webs 22′ and 22″ whereby the plate 27 can be swung about a horizontal pivotal axis, defined by these gudgeons, into a depending unblocking position indicated in phantom lines in FIGS. 7 and 8. Plate 27 accordingly acts as a hinged dust cover and, like the lid 25 of FIG. 6, may be made transparent to enable a viewing of the contents of the box in its full-line blocking position.

Advantageously, pursuant to a further feature of the invention, the box 1 is provided with two removable plugs 33 (only one shown in FIG. 7) designed to prevent the untimely detachment of the pivoted dust cover 27. Thus the box is formed at opposite ends of land 9*b* with a pair of mounting holes 23′ and 23″ in which these plugs, made of suitable resilient material, are frictionally retained. Each plug has a spur overhanging the respective gudgeon near the top of the corresponding web 22′, 22″ so as to limit the vertical motion of plate 27 to a stroke only slightly exceeding the distance 30.

As shown in FIG. 8, plate 27 may be provided with angle members 36 enabling the insertion of an identification card 37. The lid 25 of FIG. 6 could of course be similarly equipped.

Finally, as illustrated in FIG. 1, the rear wall 4 of box 1 may be provided with a recessed middle portion 34 which is overhung by a lip 35 in line with ridge 6 as shown in FIG. 5 to form an undercut finger grip enabling the box to be seized with two hands at its front and back. The convex curvature of the front ends 8*a*′, 8*a*″ of bottom flanges 8′, 8″ minimizes any jolts which the container may encounter on being transported over a roller conveyor, for example, in order to provide additional safety against spontaneous dislodgment of its closure plate 25 or 27.

I claim:

1. A stackable container comprising:

a bottom wall, two parallel sidewalls and a rear wall of sheet material defining a substantially prismatic box of rectangular horizontal outline having a U-shaped top ledge provided with an upstanding marginal ridge outwardly offset from the side rear edges of said bottom wall; and a pair of hollow upright corner profiles integral with said sidewalls at a front end of said box, said corner profiles having confronting surfaces approaching each other more closely than said sidewalls and merging into a front wall substantially lower than said sidewalls and said rear wall, said front wall rising with a forward slope from said bottom wall and forming at an upper edge thereof a forwardly bend handgrip, said upper edge and said confronting surfaces defining a lower boundary and two lateral boundaries of a rectangular opening giving access to the interior of said box, said confronting surfaces being provided above said handgrip with vertical formations defining a pair of guide grooves which rise substantially from the level of said upper edge over part of the height of said rectangular opening; and a closure plate receivable in said guide grooves to obstruct said rectangular opening, said guide grooves lying in a vertical plane located far enough forwardly of the foot of said front wall to facilitate the insertion of said closure plate from above even in the presence of an identical box seated on said top ledge and embraced by said marginal ridge.

2. A container as defined in claim 1 wherein said formations comprise a pair of coplanar forwardly facing shoulders on said corner profiles and a pair of ribs in front of said shoulders having substantially the same width as said shoulders but terminating below the level of said top ledge, said vertical plane being defined by said shoulders.

3. A container as defined in claim 2 wherein said closure plate has a major portion of a width less than the spacing of said ribs from each other, said major portion being provided at its top with a pair of lateral wings receivable in said guide grooves and at its bottom with a pair of lateral projections on a horizontal pivotal axis, said formations further including a pair of webs rising in front of said ribs to a height substantially less than the height of said ribs to form stops for said projections enabling a forward swing of said closure plate about said pivotal axis into an unblocking position upon an upward withdrawal of said wings from said grooves.

4. A contained as defined in claim 3 wherein said closure plate has a generally L-shaped body with a longer vertical leg bearing said wings and a shorter horizontal leg having a free front edge carrying said projections.

5. A container as defined in claim 3 or 4 wherein said projections are substantially cylindrical gudgeons centered on said pivotal axis.

6. A container as defined in claim 1, 2, 3 or 4 wherein said closure plate is provided at its top with a forwardly projecting tab grippable by the fingers of a user.

7. A container as defined in claim 3 or 4, further comprising plug means detachably secured to said box near the tops of said webs for preventing a lifting of said projections past said webs while enabling said wings to be raised sufficiently to clear said ribs.

8. A container as defined in claim 2, 3 or 4 wherein said shoulders rise vertically to the level of the tops of said ribs and then slope rearwardly to said top ledge.

9. A container as defined in claim 2, 3 or 4 wherein said handgrip has a vertical cross-section substantially of inverted-J shape with a depending front skirt constituting the shorter leg of the "J", said vertical plane intersecting said front wall substantially at the level of a lower edge of said front skirt, said closure plate having a height which is less than the distance between the top of said ribs and the level of the lower edge of the front skirt of an identical box seated on said top ledge.

10. A container as defined in claim 9 wherein said sidewalls have laterally projecting bottom flanges with curved front ends which merge into forwardly and upwardly sloping bottom edges of said corner profiles rising to the lower edge of said front skirt.

* * * * *